US010335666B2

(12) United States Patent
Wu

(10) Patent No.: US 10,335,666 B2
(45) Date of Patent: Jul. 2, 2019

(54) INLINE SKATE HAVING ADJUSTABLE SHOCK ABSORBER

(71) Applicant: Anita Wu, Guangdong (CN)

(72) Inventor: Anita Wu, Guangdong (CN)

(73) Assignee: Dongguan Hongmei Sports Equipment Co., Ltd., Dongguan (CN)

( * ) Notice: Subject to any disclaimer, the term of this patent is extended or adjusted under 35 U.S.C. 154(b) by 0 days.

(21) Appl. No.: 16/043,159

(22) Filed: Jul. 24, 2018

(65) Prior Publication Data

US 2018/0326293 A1 Nov. 15, 2018

(51) Int. Cl.

| | |
|---|---|
| ***A63C 17/00*** | (2006.01) |
| ***A63C 17/14*** | (2006.01) |
| ***A63C 17/06*** | (2006.01) |

(52) U.S. Cl.

CPC ..... *A63C 17/0046* (2013.01); *A63C 17/002* (2013.01); *A63C 17/06* (2013.01); *A63C 17/1436* (2013.01); *A63C 2017/1481* (2013.01); *A63C 2203/20* (2013.01)

(58) Field of Classification Search

CPC ... A63C 17/0046; A63C 17/06; A63C 17/002; A63C 17/1436; A63C 2017/1481; A63C 2203/20

See application file for complete search history.

(56) References Cited

U.S. PATENT DOCUMENTS

| | | | | | |
|---|---|---|---|---|---|
| 2,557,331 | A * | 6/1951 | Wintercorn | A63C 17/02 | 280/11.28 |
| 4,351,538 | A * | 9/1982 | Berta | A63C 17/16 | 280/11.26 |
| 5,582,418 | A * | 12/1996 | Closser | A63C 17/0046 | 280/11.225 |
| 5,931,480 | A * | 8/1999 | Schroeder | A63C 1/28 | 280/11.211 |
| 6,053,512 | A * | 4/2000 | Chang | A63C 17/0046 | 280/11.231 |
| 6,209,889 | B1 * | 4/2001 | Alfieri | A63C 1/36 | 280/11.224 |
| 6,270,090 | B1 * | 8/2001 | Gignoux | A63C 17/06 | 280/11.19 |
| 6,513,815 | B2 * | 2/2003 | Glass | A63C 17/065 | 280/11.224 |
| 6,592,131 | B1 * | 7/2003 | Bai | A63C 17/0046 | 280/11.224 |
| 7,621,541 | B2 * | 11/2009 | Perkovich | A63C 17/062 | 280/11.231 |

(Continued)

*Primary Examiner* — Erez Gurari

(57) ABSTRACT

An inline skate includes a front wheel mount secured to a bottom of a skate boot; a front wheel rotatably secured to the front wheel mount; a rear wheel mount secured to the bottom of the skate boot; a rear wheel rotatably secured to the rear wheel mount; and a shock absorber disposed between the front wheel mount and the rear wheel mount and including two sets of a positioning member secured to the skate boot; a threaded adjustment member disposed through either the rear or front wheel mount; a first bifurcation element through a biasing member and having one end secured to the adjustment member and the other two ends secured to the biasing member; and a second bifurcation element through the biasing member and having one end secured to the positioning member and the other two ends secured to the biasing member.

3 Claims, 3 Drawing Sheets

(56) References Cited

U.S. PATENT DOCUMENTS

| | | | | |
|---|---|---|---|---|
| 2001/0030404 | A1* | 10/2001 | Liu | A63C 17/0046 280/87.041 |
| 2005/0051977 | A1* | 3/2005 | Yiu Lu | A63C 17/0086 280/11.26 |
| 2007/0132201 | A1* | 6/2007 | Bellehumeur | A63C 17/1418 280/87.041 |
| 2010/0320707 | A1* | 12/2010 | Chang | A63C 17/1454 280/11.225 |
| 2011/0079976 | A1* | 4/2011 | Seip | A63C 17/0046 280/87.042 |
| 2012/0261891 | A1* | 10/2012 | Oliveira | A63C 17/0046 280/11.28 |
| 2013/0277924 | A1* | 10/2013 | Ng | A63C 17/1409 280/11.214 |
| 2014/0034796 | A1* | 2/2014 | Hering | A63C 17/0006 248/231.71 |
| 2016/0038824 | A1* | 2/2016 | Choudhary | A63C 17/062 280/11.207 |
| 2016/0250545 | A1* | 9/2016 | Yurkin | A63C 17/008 280/11.223 |
| 2016/0296828 | A1* | 10/2016 | Ewing, Jr. | A63C 17/1427 |
| 2018/0028899 | A1* | 2/2018 | Chen | A63C 17/04 |
| 2018/0243637 | A1* | 8/2018 | Jon | A63C 17/008 |
| 2018/0326293 | A1* | 11/2018 | Wu | A63C 17/0046 |

* cited by examiner

INLINE SKATE HAVING ADJUSTABLE SHOCK ABSORBER

BACKGROUND OF THE INVENTION

1. Field of the Invention

The invention relates to inline skates and more particularly to an inline skate including a shock absorber having a length adjustable biasing member (e.g., torsion spring) so that shock and jarring of the inline skates can be greatly decreased when an individual wears the inline skates to move quickly across a surface.

2. Description of Related Art

Conventionally, the frame of an inline skate is made of plastic and is light. A skate boot is mounted on the frame. A plurality of holes are provided through either downward extending flange of the frame. Front and rear wheels are rotatably mounted between two opposite front holes and two opposite rear holes respectively.

However, no shock absorber or the like is provided by the conventional inline skate. Thus, shock and jarring of the inline skates are increased greatly when an individual wears the inline skates to move quickly across a surface with irregularities. This can decrease skating speed and may further cause pain to the user's knees and/or other parts of the legs if sufficient care is not taken.

Thus, the need for improvement still exists.

SUMMARY OF THE INVENTION

It is therefore one object of the invention to provide an inline skate comprising a skate boot; a front wheel mount secured to a front portion of a bottom of the skate boot; a front wheel rotatably secured to the front wheel mount; a rear wheel mount secured to a rear portion of the bottom of the skate boot; a rear wheel rotatably secured to the rear wheel mount; a shock absorber disposed between the front wheel mount and the rear wheel mount; a protective member disposed on the shock absorber; and a brake block attached to a rear end of the skate boot with both the rear wheel mount and the rear wheel disposed below; wherein the shock absorber comprises two sets of a positioning member secured to the bottom of the skate boot; a threaded adjustment member disposed through either the rear wheel mount or the front wheel mount; a biasing member; a first bifurcation element disposed through the biasing member, the first bifurcation element having one end secured to an end of the threaded adjustment member and the other two ends secured to the other end of the biasing member; and a second bifurcation element disposed through the biasing member, the second bifurcation element having one end secured to the positioning member and the other two ends secured to one end of the biasing member.

The above and other objects, features and advantages of the invention will become apparent from the following detailed description taken with the accompanying drawings.

DETAILED DESCRIPTION OF THE INVENTION

Figure 1:
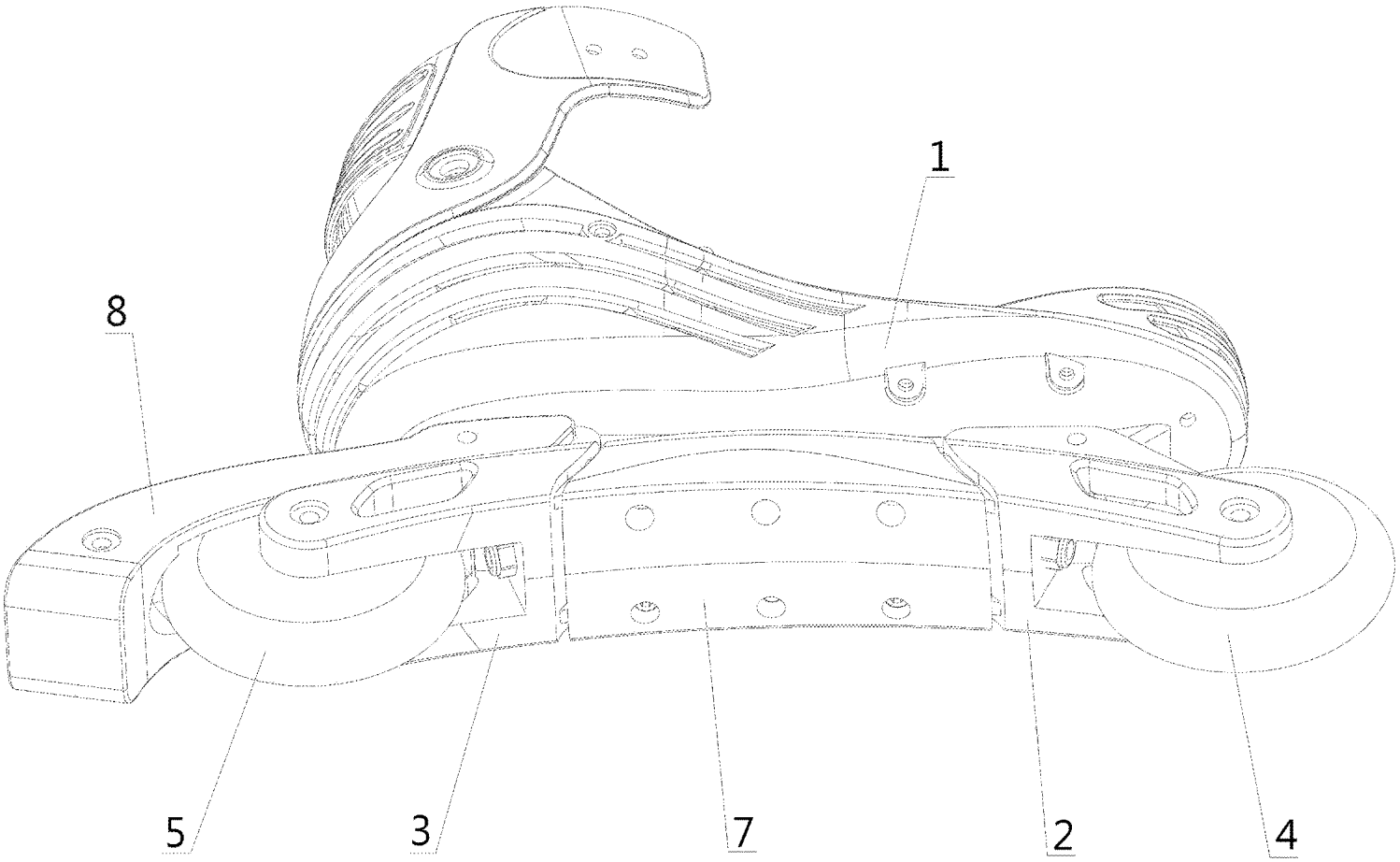
FIG. 1 is a perspective view of an inline skate according to the invention.
Figure 2:
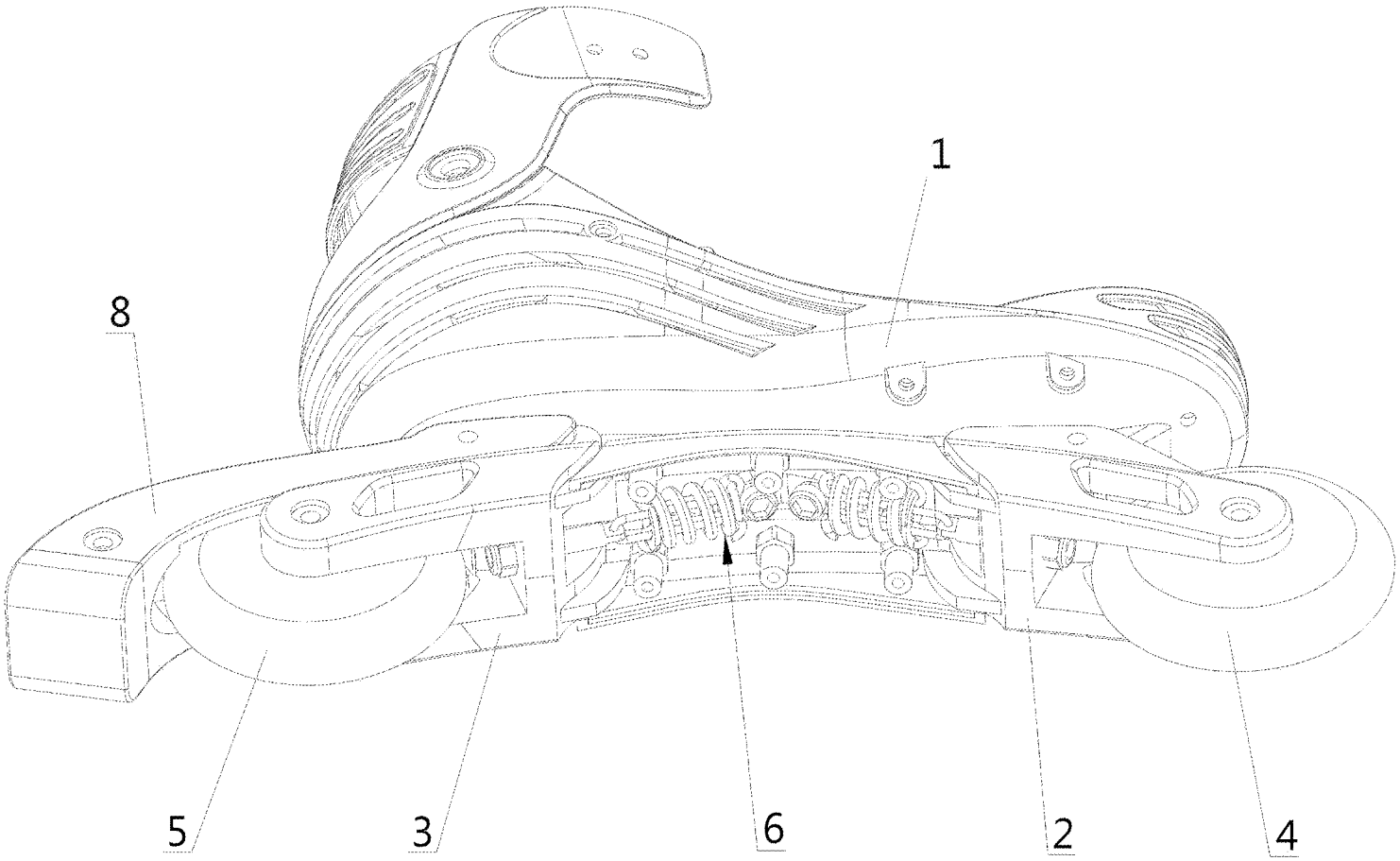
FIG. 2 is a view similar to FIG. 1 with the protective member removed.
Figure 3:
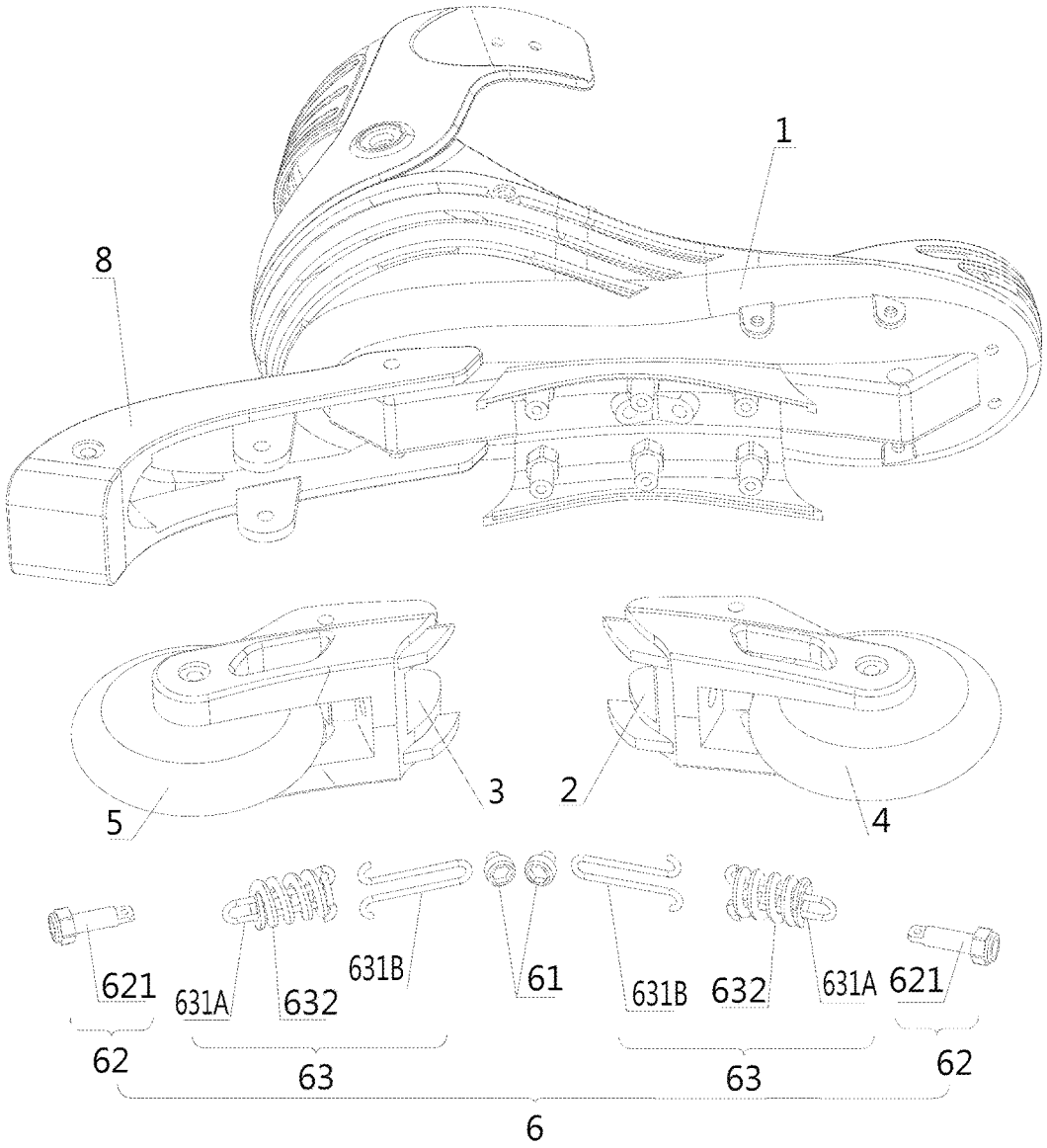
FIG. 3 is an exploded view of FIG. 2 showing components of the shock absorber.

Referring to FIGS. 1 to 3, an inline skate in accordance with the invention comprises a skate boot 1, a front wheel mount 2 secured to a front portion of a bottom of the skate boot 1, a front wheel 4 rotatably secured to the front wheel mount 2, a rear wheel mount 3 secured to a rear portion of a bottom of the skate boot 1, a rear wheel 5 rotatably secured to the rear wheel mount 3, a shock absorber 6 disposed between the front wheel mount 2 and the rear wheel mount 3, a protective member 7 mounted on the shock absorber 6, and a brake block 8 attached to a rear end of the skate boot 1 with both the rear wheel mount 3 and the rear wheel 5 disposed below.

The shock absorber 6 as the subject of the invention is discussed in detail below. The shock absorber 6 comprises two sets of components in which one set of components comprises a positioning member 61 secured to the skate boot 1; an adjustment member (e.g., an adjustment screw) 62 having a threaded shank 621 adjustably fastened through a threaded hole (not shown) in the rear wheel mount 3; and a biasing assembly 63 including a biasing member (e.g., torsion spring) 632, a first bifurcation element 631A disposed through the biasing member 632, the first bifurcation element 631A having one end secured to an end of the adjustment member 62 and the other two hooked ends secured to the other end of the biasing member 632, and a second bifurcation element 631B disposed through the biasing member 632, the second bifurcation element 631B having one end secured to the positioning member 61 and the other two hooked ends secured to one end of the biasing member 632.

An individual may use one hand to clockwise rotate the adjustment member 62. And in turn, the first bifurcation element 631A is pulled toward the rear wheel mount 3. Thus, the biasing member 632 is compressed. As a result, a damping force of the shock absorber 6 is increased.

To the contrary, the user may use one hand to counterclockwise rotate the adjustment member 62. And in turn, the first bifurcation element 631A is pulled away from the rear wheel mount 3. Thus, the biasing member 632 is expanded. As a result, a damping force of the shock absorber 6 is decreased.

The other set of components of the shock absorber 6 are the same as that described above and further, adjustment of the damping force of the shock absorber 6 by means of the other set of components of the shock absorber 6 is the same as that described above. Thus, a detailed description thereof is omitted herein for the sake of brevity.

It is envisaged by the invention that the shock absorbers 6 can greatly decrease shock and jarring of the inline skates when an individual wears the inline skates to move quickly across a surface. Further, the protective member 7 may enable the inline skate to slide obliquely when the inline skate collides with a foreign object. Furthermore, length of the biasing member 632 is adjustable to accommodate wearers of different weights. In addition, the damping force of the shock absorber 6 can be increased or decreased by adjustment.

While the invention has been described in terms of preferred embodiments, those skilled in the art will recognize that the invention can be practiced with modifications within the spirit and scope of the appended claims.

What is claimed is:

1. An inline skate, comprising:

a skate boot;

a front wheel mount secured to a front portion of a bottom of the skate boot;

a front wheel rotatably secured to the front wheel mount;

a rear wheel mount secured to a rear portion of the bottom of the skate boot;

a rear wheel rotatably secured to the rear wheel mount;

a shock absorber disposed between the front wheel mount and the rear wheel mount;

a protective member disposed on the shock absorber; and a brake block attached to a rear end of the skate boot with both the rear wheel mount and the rear wheel disposed below;

wherein the shock absorber comprises two sets of a positioning member secured to the bottom of the skate boot; a threaded adjustment member disposed through either the rear wheel mount or the front wheel mount; a biasing member; a first bifurcation element disposed through the biasing member, the first bifurcation element having one end secured to an end of the threaded adjustment member and the other two ends secured to the other end of the biasing member; and a second bifurcation element disposed through the biasing member, the second bifurcation element having one end secured to the positioning member and the other two ends secured to one end of the biasing member.

2. An inline skate, comprising:

a skate boot;

a front wheel mount secured to a front portion of a bottom of the skate boot;

a front wheel rotatably secured to the front wheel mount;

a rear wheel mount secured to a rear portion of the bottom of the skate boot;

a rear wheel rotatably secured to the rear wheel mount;

a shock absorber disposed between the front wheel mount and the rear wheel mount;

a protective member disposed on the shock absorber; and a brake block attached to a rear end of the skate boot with both the rear wheel mount and the rear wheel disposed below;

wherein the shock absorber comprises a positioning member secured to the bottom of the skate boot; a threaded adjustment member disposed through the rear wheel mount; a biasing member; a first bifurcation element disposed through the biasing member, the first bifurcation element having one end secured to an end of the threaded adjustment member and the other two ends secured to the other end of the biasing member; and a second bifurcation element disposed through the biasing member, the second bifurcation element having one end secured to the positioning member and the other two ends secured to one end of the biasing member.

3. An inline skate, comprising:

a skate boot;

a front wheel mount secured to a front portion of a bottom of the skate boot;

a front wheel rotatably secured to the front wheel mount;

a rear wheel mount secured to a rear portion of the bottom of the skate boot;

a rear wheel rotatably secured to the rear wheel mount;

a shock absorber disposed between the front wheel mount and the rear wheel mount;

a protective member disposed on the shock absorber; and a brake block attached to a rear end of the skate boot with both the rear wheel mount and the rear wheel disposed below;

wherein the shock absorber comprises a positioning member secured to the bottom of the skate boot; a threaded adjustment member disposed through the front wheel mount; a biasing member; a first bifurcation element disposed through the biasing member, the first bifurcation element having one end secured to an end of the threaded adjustment member and the other two ends secured to the other end of the biasing member; and a second bifurcation element disposed through the biasing member, the second bifurcation element having one end secured to the positioning member and the other two ends secured to one end of the biasing member.

* * * * *